US006029471A

United States Patent [19]

Taylor

[11] Patent Number: 6,029,471

[45] Date of Patent: Feb. 29, 2000

[54] ENVELOPING HEAT ABSORBER FOR IMPROVED REFRIGERATOR EFFICIENCY AND RECOVERY OF REJECT HEAT FOR WATER HEATING

[76] Inventor: Christopher Taylor, 4209 Province Dr., Wilmington, N.C. 28405

[21] Appl. No.: 08/030,734

[22] Filed: Mar. 12, 1993

[51] Int. Cl.[7] ..... F25D 19/00; F24D 19/02

[52] U.S. Cl. ..... 62/453; 62/516; 62/523; 62/259.1; 165/53

[58] Field of Search ..... 62/453, 516, 517, 62/523, 238.6, 238.7, 259.1, 263; 165/49, 50, 53, 54

[56] References Cited

U.S. PATENT DOCUMENTS

| | | | |
|---|---|---|---|
| 272,653 | 2/1883 | Cogswell | 62/259.1 |
| 2,167,394 | 7/1939 | Smith | 62/523 |
| 2,191,198 | 2/1940 | Gould | 62/453 |
| 2,349,695 | 5/1944 | Beane | 62/516 |
| 2,356,778 | 8/1944 | Morrison | 62/453 |
| 3,972,204 | 8/1976 | Sidorenko et al. | 62/447 |
| 4,143,703 | 3/1979 | Creswick et al. | 165/1 |
| 4,250,957 | 2/1981 | McClendon | 165/45 |
| 4,386,500 | 6/1983 | Sigafoose | 62/79 |
| 4,399,664 | 8/1983 | Derosier | 62/238.7 |
| 4,407,142 | 10/1983 | O'Reilly | 62/238.6 |

FOREIGN PATENT DOCUMENTS

| | | | |
|---|---|---|---|
| 378261 | 8/1932 | United Kingdom | 62/453 |

*Primary Examiner*—William Doerrler

[57] ABSTRACT

In refrigeration; in order to transfer heat from the heat supplier, or to the heat absorber, it is necessary that temperature gradients be maintained between said heat exchangers and the interacting medium. These temperature gradients increase the difference between the temperature of the heat supplier and that of the heat absorber. The efficiency of refrigeration systems decrease as said temperature differences increase. Said mediums, if gaseous, as they frequently are, offer great resistance to heat transfer. This results in large temperature gradients and substantially reduces refrigeration efficiency. The present invention involves enveloping the enclosed space with the enclosure heat exchanger so that less heat has to be transferred through the gaseous contents, and additional, inexpensive, heat transfer surface becomes available. The reduction in temperature gradients result in increased efficiency.

Recovery of reject heat for residential type water heating is also included as a natural extension.

17 Claims, 6 Drawing Sheets

ENVELOPING HEAT ABSORBER FOR IMPROVED REFRIGERATOR EFFICIENCY AND RECOVERY OF REJECT HEAT FOR WATER HEATING

BACKGROUND OF THE INVENTION

0. Definitions Used

Refrigeration Systems: can also include Heat Pumps and Combination Refrigeration and Heat Pump Systems Refrigerator: can include the alternative appliances, Refrigerator/Freezer or Freezer, in appropriate contexts Enclosure Heat Exchanger: Heat Absorber In Refrigeration Systems, Heat Supplier In Heat Pumps, Either Or Both In Combination Refrigeration/Heat Pump Systems Surroundings Heat Exchanger: Heat Suppliers In Refrigeration Systems, Heat Absorbers In Heat Pumps Heat Absorbers: Evaporators In Vapor Compression Systems And Absorption Systems, Cold Plates In Solid State Systems Heat Suppliers: Condensers In Vapor Compression Systems, Refrigerant Absorbers In Absorption Systems, Hot Plates In Solid State Systems 1. Field of the Invention The present invention relates to improved refrigeration systems, and specifically to reducing net operating costs, by increasing the effectiveness of Enclosure Heat Exchangers and, specifically in residential type refrigerators, by recovering the reject heat for heating water.

2. Prior Art

Refrigeration Systems are used for maintaining the contents of enclosed spaces at temperatures below or above the temperature of the surroundings. In some cases the functions of refrigeration and heat pumping are combined to keep the contents of one or more enclosed spaces at relatively low temperatures while also keeping the contents of one or more other enclosed spaces at relatively high temperatures. The objective is frequently to delay deterioration of the contents of the enclosed space, to maintain enclosed spaces at comfortable temperatures for occupation by humans or other animals, or to adjust the temperature of materials in preparation for use.

In the past the contents of the enclosed spaces have been maintained, at the desired temperatures, by Enclosure Heat Exchangers which exchange heat with the contents of the enclosed space. Said heat transfer is required to counteract heat which is transferred (by conduction, convection or radiation) through the enclosing walls, which are normally insulated, in addition to heat transferred along with material exchanged between the surrounding space and the enclosed space and heat generated or absorbed within the enclosed space (e.g. by chemical reaction).

Frequently the contents of said enclosed spaces include gasses, such as air, and the heat is frequently exchanged between the Enclosure Heat Exchangers and said gasses. Except during upset conditions there is frequently little or no net exchange of heat between the gaseous contents and the other contents because their temperatures tend towards equality at equilibrium.

The heat transfer coefficients between heat exchange surfaces, such as the surfaces of said Enclosure Heat Exchangers, and gasses are very low, as is well known to workers in the heat transfer field. Since the heat flow rate is approximately proportional to the product of said coefficient, the heat exchange area, and the temperature differential, it is necessary for the refrigerating means to depress or maintain the temperature of said enclosure heat exchanger so as to maintain a large temperature differential in order to drive the heat exchange between Enclosure Heat Exchangers and gaseous contents. The alternative of providing large heat transfer surfaces is limited by cost and available space. The maintenance of said large temperature differentials, for heat transfer, results in large differences between the temperatures of the Heat Supplier and the Heat Absorber of the Refrigeration System. As is well known to workers in the field of refrigeration, the efficiency of Refrigeration Systems increase as said temperature differences decrease. Consequently the maximum achievable efficiency of the Refrigeration System is very substantially affected by the fact that the heat load must be transferred between said gas and said Enclosure Heat Exchanger.

Typical residential refrigerators operate with heat absorber temperatures about 25° F. below the temperature of the freezer compartment and about 60° F. below the temperature of the storage cabinet. Previous efforts to reduce the effect, of said low heat transfer coefficients, on efficiency, have included the use of large and/or extended surface heat absorbers and suppliers, and forced circulation, of the gaseous contents, across the heat exchange surfaces, to increase coefficients and maintain localized temperature differentials. The use of separate refrigeration systems, for the freezer and cabinet, has been practiced by Schlussler, of Sun Frost, Arcata, Calif., to reduce the temperature difference between the storage cabinet's Heat Supplier and Heat Absorber.

Numerous other efforts have been directed towards reduced energy requirements.

These include insulation improvements, defrost cycle improvements, and compressor and fan efficiency improvements. These also tend to indirectly reduce the effect of the low heat transfer coefficients by reducing the heat load which must be transferred across the available heat exchange surface. In HVAC applications the use of variable speed high efficiency compressors and fans, and alternative heat sinks and/or reservoirs including water and the ground have been applied. Tyree (U.S. Pat. No. 4,498,306) has described a system, including enclosing means, for goods to be transported in a space to be maintained at depressed temperatures, enclosed by said enclosing means which uses means superficially similar to the present invention. Tyree describes tubes, set into the walls of transports, and attached to thermally conductive strips. Heat entering the transport through the insulated walls is "intercepted" by said strips. The heat transferred to said tubes causes refrigerant inside said tubes to evaporate. By thermosyphon, said heat is transferred to solid carbon dioxide or liquid nitrogen etc., which evaporates and is vented, thus discarding said heat to the atmosphere. Tyree's worthy objective is to control the temperature and provide uniform temperatures throughout said transport. Tyree's invention does not achieve improvement in efficiency by use of envelopment except in some extremely limited circumstances. The amount of heat absorbed by the enveloping strips and tubes is not significantly less than that which would be absorbed by a heat exchanger immersed in the atmosphere of the transport, and the amount of carbon dioxide or nitrogen evaporated is proportional to the amount of heat absorbed. Although an "immersed" type heat exchanger might have to operate at a lower temperature than would the enveloping system of strips and tubes the amount of carbon dioxide or nitrogen evaporated is not reduced as a result. The said limited circumstances in which Tyree's invention results in (the equivalent of) improved efficiency comprise circumstances where the temperature desired for the enclosed space is very slightly more than the minimum evaporation temperature of a relatively inexpensive substance such as carbon dioxide. Using Tyree's invention it is possible to achieve said desired temperature by evaporating the less expensive substance while said "immersed" type heat exchanger, which may have to operate at a lower temperature, may require that a lower boiling substance, such as liquid nitrogen be evaporated. Assuming solid or liquid carbon dioxide to be available at a lower cost per unit heat of evaporation, then Tyree's invention would result in the financial equivalent of improved efficiency relative to a heat exchanger immersed in the contents of the transport, under these, and similar, limited range circumstances.

Use has also been made of evaporator tubes, buried in the walls of refrigerator cabinets, to reduce frosting by ensuring that the cooling of the contents of the cabinet, which are frequently maintained slightly above the freezing temperature of water, does not all have to be accomplished by contacting them with a surface which is at a temperature below the freezing temperature of water. However, since this objective was accomplished without also raising the evaporator temperature, efficiency was not increased except possibly by reducing the effect on efficiency of the insulating layer of frost.

Although the above referenced contributions have improved the performance of refrigeration systems, and in some cases have increased efficiency, or in other ways reduced operating costs, none of them have achieved or fulfilled the objectives of the present invention; one of which is to reduce operating costs, by reducing the temperature difference between the heat supplier and the heat absorber, by reducing the temperature differentials required for heat transfer, by use of Enveloping Enclosure Heat Exchangers; and the second of which is by the recovery of the reject heat, specifically, from residential type refrigerators for use in meeting residential type requirements for hot water.

SUMMARY OF THE INVENTION

One objective of the present invention is to increase the efficiency of Refrigeration Systems by reducing the difference between the operating temperature of the Heat Supplier and the operating temperature of the Heat Absorber, said reduction in temperature difference being achieved; by reducing the temperature differentials, required for heat transfer between the contents of the enclosure and the Enclosure Heat Exchanger; which is achieved by shaping and positioning said Enclosure Heat Exchanger so as to envelop or largely envelop the enclosed space. The primary benefit of said feature is that those parts of the heat load, which are transferred (by conduction, convection or radiation) through the enclosing walls, are exchanged directly, thus reducing the amount of heat which must be transferred between the contents of the enclosed space and the Enclosure Heat Exchanger. The secondary benefit of said feature, is the provision of additional, relatively inexpensive and unobtrusive, heat transfer surface between the contents of the enclosed space and the Enclosure Heat Exchanger, said heat transfer surface being rendered relatively inexpensive and unobtrusive because the heat transfer material also serves as part of the enclosing wall. A further objective, specifically regarding residential type refrigerators, is to reduce net overall operating costs for refrigeration and water heating by recovering refrigerators' reject heat for heating water.

DETAILED DESCRIPTION

Figure 1:
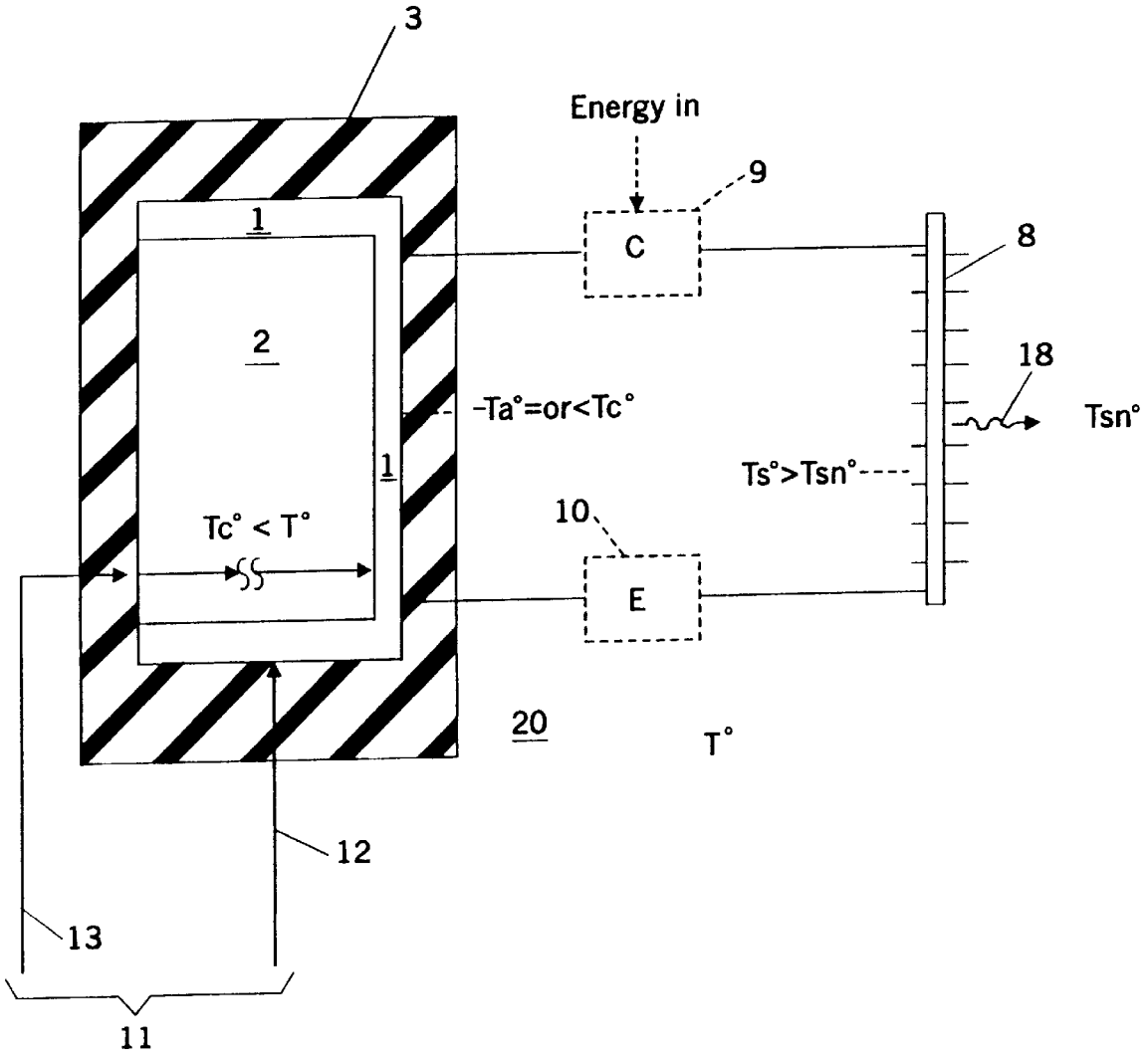
FIG. 1 is a process flow schematic of a refrigeration system, with a largely enveloping Enclosure Heat Exchanger.

As shown in FIG. 1, the present invention includes an improvement; to the refrigeration process, by which the contents of an enclosed space 2, separated from its surroundings, are maintained at a temperature Tc° which is less than T° the temperature of the surroundings; said IMPROVEMENT COMPRISING CONSTRUCTION OF THE HEAT ABSORBER 1 SO AS TO ENVELOP, OR LARGELY ENVELOP, SAID ENCLOSED SPACE, instead of as a heat exchanger immersed in said contents, which increases the efficiency of said refrigeration process; due to effecting the reduced difference between the operating temperatures of the heat supplier and said heat absorber; afforded by the reduction in temperature difference, required to drive the transfer of heat from said contents to said heat absorber; permitted firstly by the reduction in the amount of heat needing to be so transferred, because said enveloping, or largely enveloping, heat absorber intercepts much of the heat entering the enclosure, through containing walls of said enclosure (by means comprising conduction, convection or radiation), said intercepted heat then not contributing to that which is transferred both from said surroundings to said contents and from said contents to said heat absorber, and permitted secondly by the relatively inexpensive, and unobtrusive, increase in heat transfer surface between said contents and said heat absorber, afforded by the enveloping, or largely enveloping, heat absorber being also the liner of said enclosure.

Heat Absorber 1, is maintained at a temperature Tao, which is less than Tc° if envelopment is partial but which could be almost equal to Tc° if envelopment is almost complete.

The enclosure, comprising said Heat Absorber 1 and any sealing material (not shown or numbered in the drawing) which may be necessary to fill any gaps if the envelopment is less than complete, is surrounded by thermal insulation 3.

A Heat Supplier 8, which is immersed in the surroundings, or a heat sink, is maintained at a temperature Ts°, which is greater than the temperature Tsn° of the heat sink.

Heat 12 is transferred from the surroundings 20, through the insulation, directly to the Heat Absorber 1 under the influence of the temperature differential (T°–Ta°). If the envelopment is less than complete then heat 13 is transferred from the surroundings 20 to the contents of the enclosed space 2 under the influence of the temperature differential (T°–Tc°), and from said contents to the Heat Absorber 1 under the influence of the temperature differential (Tc°–Ta°). Heat 11, the sum of heat 13 and heat 12, is the total heat absorbed by the Heat Absorber.

Heat 18 is transferred from the Heat Supplier 8 to the heat sink under the influence of the temperature differential (Ts°–Tsn°). In order to maintain the temperature difference (Ts°–Ta°) energy is supplied to the Refrigeration System at 9.

Since the amount of heat 13, is less than it would be if the Heat Absorber 1 was replaced by a Heat Absorber of the type which is immersed in the contents of the enclosed space, and since the heat transfer area in contact with the contents of the enclosed space, is almost equal to the entire inside area of the lining of the enveloped part of the enclosure, and therefore usually greater than that of a Heat Absorber of said "immersed" type, the temperature differential (Tc°–Ta°) is much less than it would be if a Heat Absorber of said "immersed" type was used. Consequently the temperature difference (Ts°–Ta°) is less than it would be if a Heat Absorber of said "immersed" type was used. Consequently the energy input required at 9 to maintain said temperature difference (Ts°–Ta°) is less than it would be if a Heat Absorber of said "immersed" type was used.

Figure 2:
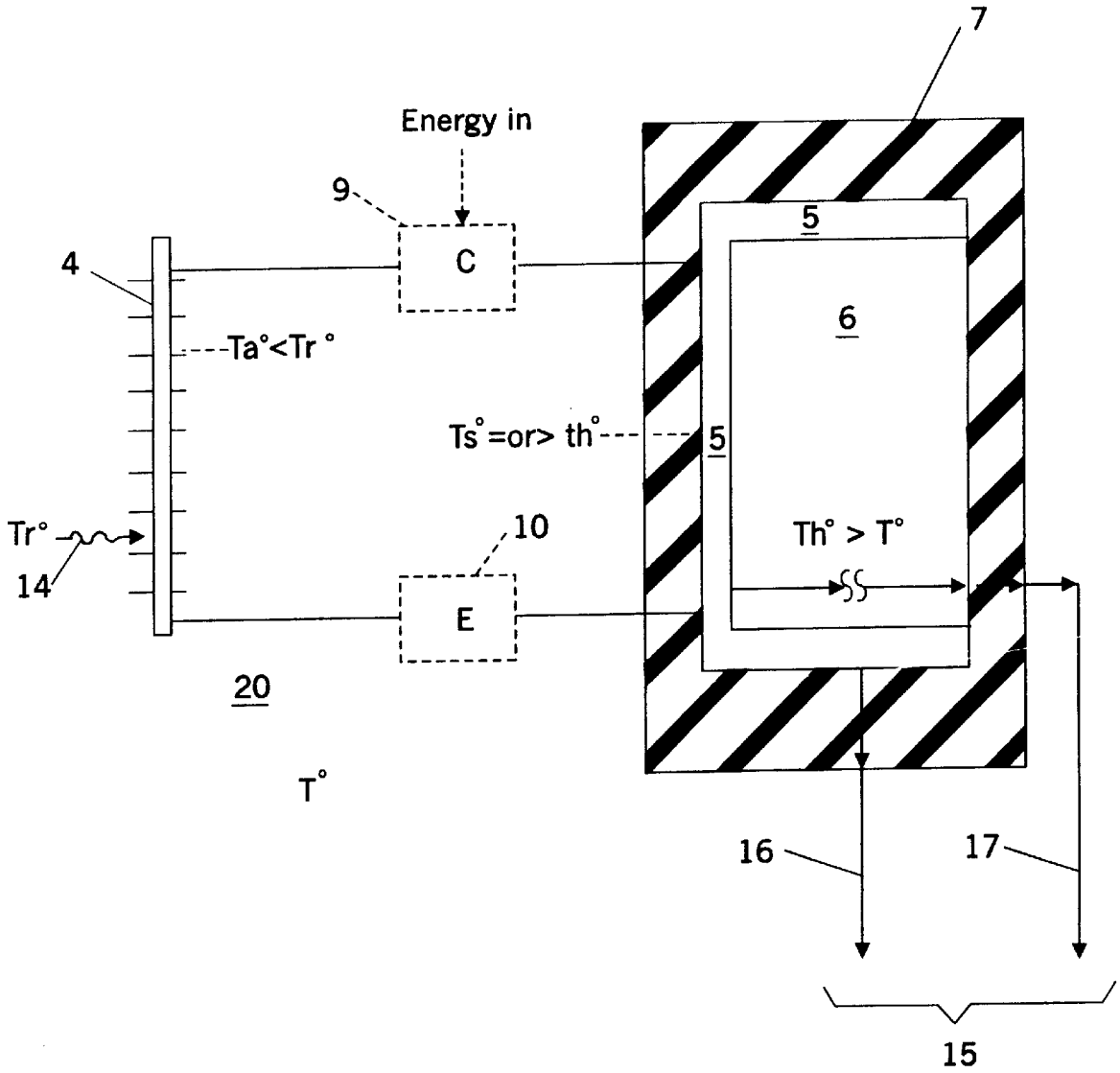
FIG. 2 is a process flow schematic of a heat pump system, with a largely enveloping Enclosure Heat Exchanger.

As shown in FIG. 2, the present invention also includes an improvement; to the heat pumping process, by which the contents of an enclosed space 6, separated from its surroundings, are maintained at a temperature Th°, which is greater than T° the temperature of the surroundings; said IMPROVEMENT COMPRISING CONSTRUCTION OF THE HEAT SUPPLIER SO AS TO ENVELOP, OR LARGELY ENVELOP, SAID ENCLOSED SPACE, instead of as a heat exchanger immersed in said contents, which increases the efficiency of said heat pumping process; due to effecting the reduced difference between the operating temperatures of said heat supplier and the heat absorber; afforded by the reduction in temperature difference, required to drive the transfer of heat to said contents from said heat supplier; permitted firstly by the reduction in the amount of heat needing to be so transferred, because said enveloping, or largely enveloping, heat supplier supplies directly much of the heat escaping from the enclosure, through containing walls of said enclosure (by means comprising conduction, convection or radiation), said directly supplied heat then not contributing to that which is transferred both to said surroundings from said contents and to said contents from said heat supplier, and permitted secondly by the relatively inexpensive, and unobtrusive, increase in heat transfer surface between said contents and said heat supplier, afforded by said enveloping, or largely enveloping, heat supplier being also the liner of said enclosure.

Heat Supplier 5, is maintained at a temperature Ts°, which is greater than Th° if envelopment is partial but which could be almost equal to Th° if envelopment is almost complete.

The enclosure, comprising said Heat Supplier 5 and any sealing material (not shown or numbered in the drawing) which may be necessary to fill any gaps if the envelopment is less than complete, is surrounded by thermal insulation 7.

A Heat Absorber 4, which is immersed in the surroundings, or a heat reservoir, is maintained at a temperature Tao, which is less than the temperature Tr° of the heat reservoir. Heat 16 is transferred to the surroundings 20, through the insulation, directly from the Heat Supplier 5 under the influence of the temperature differential (Ts°–T°). If the envelopment is less than complete then heat 17 is transferred to the surroundings 20 from the contents of the enclosed space 6 under the influence of the temperature differential (Th°–T°), and to said contents from the Heat Supplier 5 under the influence of the temperature differential (Ts°–Th°). Heat 15, the sum of heat 16 and heat 17, is the total heat supplied by the Heat Supplier.

Heat 14 is transferred to the Heat absorber 4 from the heat reservoir under the influence of the temperature differential (Tr°–Ta°).

In order to maintain the temperature difference (Ts°–Ta°) energy is supplied to the Heat Pumping System at 9.

Figure 3:
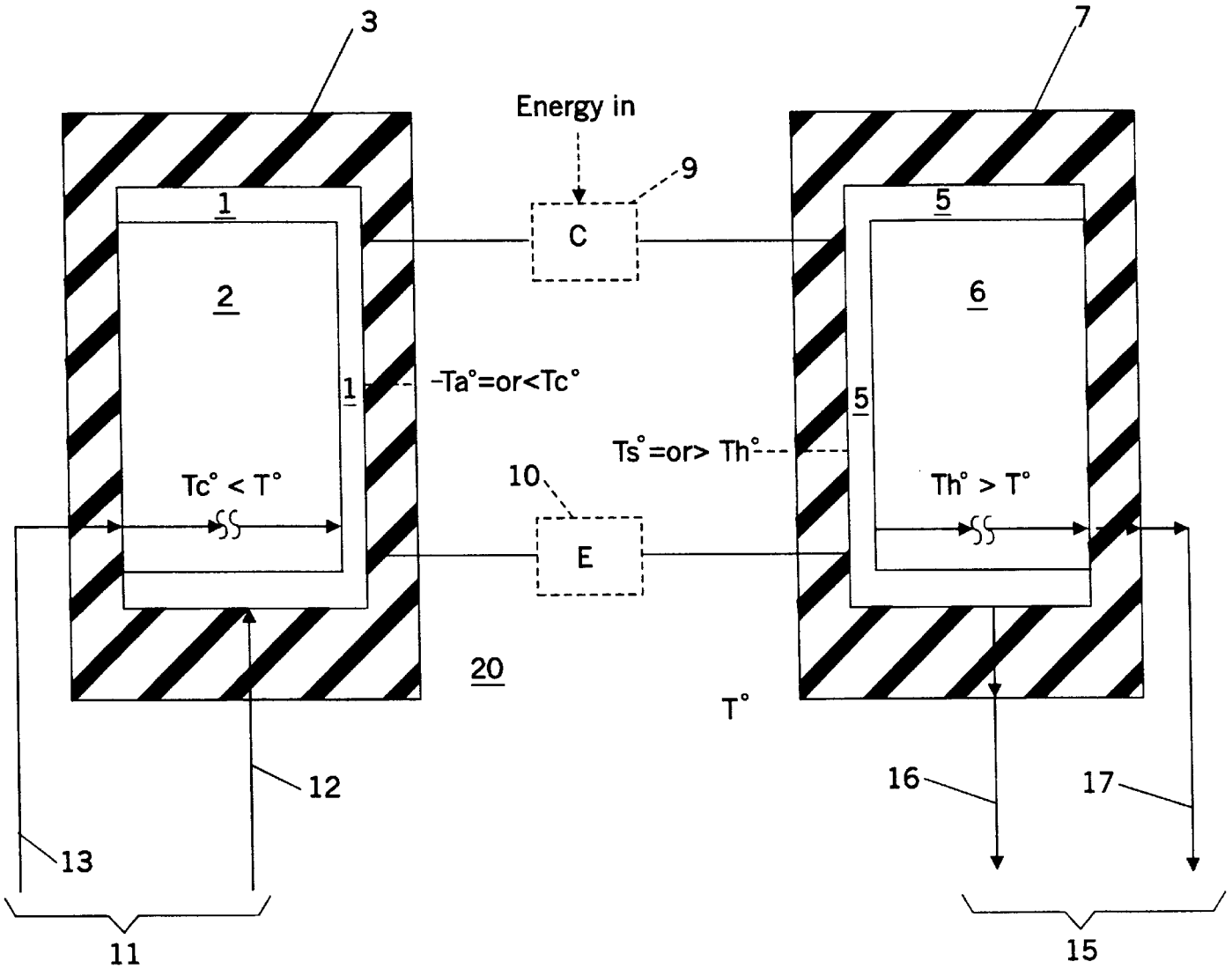
FIG. 3 is a process flow schematic of a combination refrigeration/heat pump system, with largely enveloping Enclosure Heat Exchangers.

Since the amount of heat 17, is less than it would be if the Heat Supplier 5 was replaced by a Heat Supplier of the type which is immersed in the contents of the enclosed space, and since the heat transfer area, in contact with the contents of the enclosed space, is almost equal to the entire inside area of the lining of the enveloped part of the enclosure, and therefore usually greater than that of a Heat Supplier of said "immersed" type, the temperature differential (Ts°–Th°) is much less than it would be if a Heat Supplier of said "immersed" type was used. Consequently the temperature difference (Ts°–Ta°) is less than it would be if a Heat Supplier of said "immersed" type was used. Consequently the energy input required at 9 to maintain said temperature difference (Ts°–Ta°) is less than it would be if a Heat Absorber of said "immersed" type was used. As shown in FIG. 3, the present invention also includes an improvement; to the combination refrigeration/heat pumping process, by which the contents of an enclosed space 2, separated from its surroundings, are maintained at a temperature Tc° which is less than T° the temperature of the surroundings, while the contents of another enclosed space 6, separated from its surroundings, are maintained at a temperature Th° which is greater than T° the temperature of the surroundings; said IMPROVEMENT COMPRISING CONSTRUCTION OF BOTH, OR EITHER, THE HEAT ABSORBER AND HEAT SUPPLIER SO AS TO ENVELOP, OR LARGELY ENVELOP, THEIR RESPECTIVE ENCLOSED SPACES, instead of as heat exchangers immersed in said contents, which increases the efficiency of said refrigeration/heat pumping process; due to effecting the reduced difference between the operating temperatures of the heat supplier and the heat absorber; afforded by the reduction in temperature differences, required to drive the transfer of heat between said contents and said Enclosure Heat Exchangers; permitted firstly by the reduction in the amount of heat needing to be so transferred, because said enveloping, or largely enveloping, heat exchangers exchange heat directly with the surroundings, through containing walls of their respective enclosures (by means comprising conduction, convection or radiation), said directly exchanged heat then not contributing to that which is exchanged both between said surroundings and said contents and between said contents and said heat exchangers, and permitted secondly by the relatively inexpensive, and unobtrusive, increase in heat transfer surface between said contents and said heat exchangers, afforded by said enveloping, or largely enveloping, heat exchangers being also the liners of said enclosures. Heat Absorber 1, is maintained at a temperature Tao, which is less than Tc° if envelopment is partial but which could be almost equal to Tc° if envelopment is almost complete.

Heat Supplier 5, is maintained at a temperature Ts°, which is greater than Th° if envelopment is partial but which could be almost equal to Th° if envelopment is almost complete.

The enclosure, comprising said Heat Absorber 1 and any sealing material (not shown or numbered in the drawing) which may be necessary to fill any gaps if the envelopment is less than complete, is surrounded by thermal insulation 3.

The enclosure, comprising said Heat Supplier 5 and any sealing material (not shown or numbered in the drawing) which may be necessary to fill any gaps if the envelopment is less than complete, is surrounded by thermal insulation 7.

Heat 12 is transferred from the surroundings 20, through the insulation, directly to the Heat Absorber 1 under the influence of the temperature differential (T°–Ta°). If the envelopment is less than complete then heat 13 is transferred from the surroundings 20 to the contents of the enclosed space 2 under the influence of the temperature differential (T°–Tc°), and from said contents to the Heat Absorber 1 under the influence of the temperature differential (Tc°–Ta°). Heat 11, the sum of heat 13 and heat 12, is the total heat absorbed by the Heat Absorber.

Heat 16 is transferred to the surroundings 20, through the insulation, directly from the Heat Supplier 5 under the influence of the temperature differential (Ts°–T°). If the envelopment is less than complete then heat 17 is transferred to the surroundings 20 from the contents of the enclosed space 6 under the influence of the temperature differential (Th°–T°o), and to said contents from the Heat Supplier 5 under the influence of the temperature differential (Ts°–Th°). Heat 15, the sum of heat 16 and heat 17, is the total heat supplied by the Heat Supplier.

To maintain the temperature difference (Ts°–Ta°) energy is supplied to the Combination Refrigeration/Heatpumping System at 9. Since the amounts of heats 13 and 17, are less than they would be if the Enclosure Heat Exchangers 1 and 5 were replaced by "immersed" type exchangers, and since the heat transfer areas in contact with the contents of said Enclosure Heat Exchangers 1 and 5 are almost equal to the entire inside areas of the lining of the enveloped parts of their respective enclosures, and therefore usually greater than those of "immersed" type exchangers, temperature differentials (Ts°–Th°) and (Tc°–Ta°) are less than they would be if exchangers of said "immersed" type were used. Consequently the temperature difference (Ts°–Ta°) is less than it would be if exchangers of said "immersed" type were used. Consequently the energy input required at 9 to maintain said IS temperature difference (Ts°–Ta°) is less than it would be if exchangers of said "immersed" type were used.

As indicated in FIGS. 1 and 2 the function of the heat sink or heat reservoir may, in some cases, be performed by the surroundings. If so Tsn° or Tr° respectively=T°.

In the drawings:

"Refrigeration System" can be: Either a vapor compression system, in which case the energy input at 9 is compression work, 10 is an expansion orifice or other pressure reducer and the heat absorber and supplier are an evaporator and a condenser respectively. Or an absorption system, in which case the energy input shown at 9 depicts the net effect of heat supplied to the generator and heat removed at the absorber, and the heat absorber and supplier are refrigerant evaporator and condenser. respectively. Or a solid state refrigeration system, otherwise known as a thermoelectric refrigeration system, in which case the energy input shown at 9 depicts the electrical energy supplied to the system, and the heat absorber and supplier are cold and hot plates, comprising the cold and hot junctions respectively, of said thermoelectric refrigeration system respectively. The invention can also be used with other refrigeration cycles.

Figure 4:
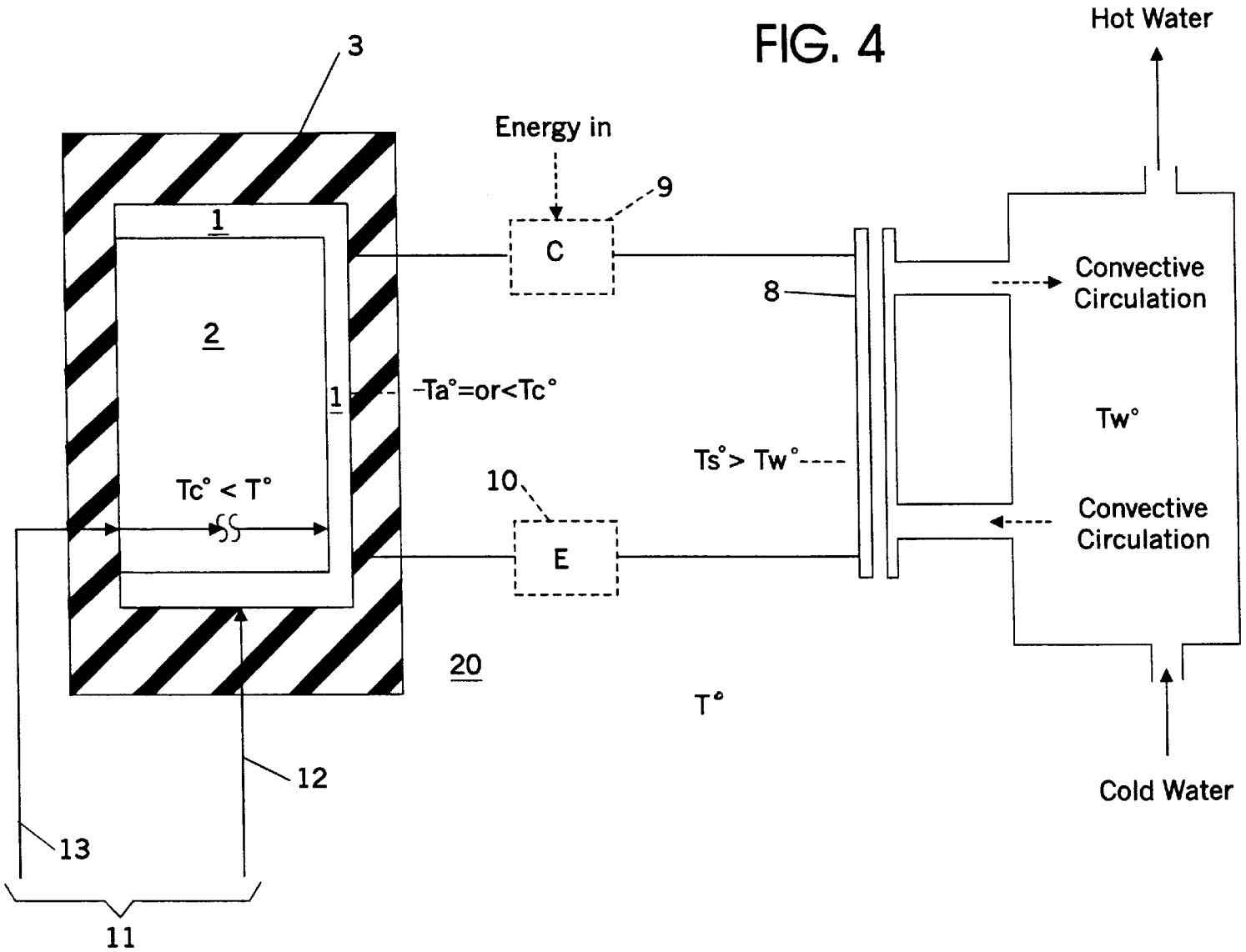
FIG. 4 is a process schematic of a combination system for using reject heat from a refrigerator for heating water using a non-enveloping heat supplier, and convective circulation.
Figure 5:
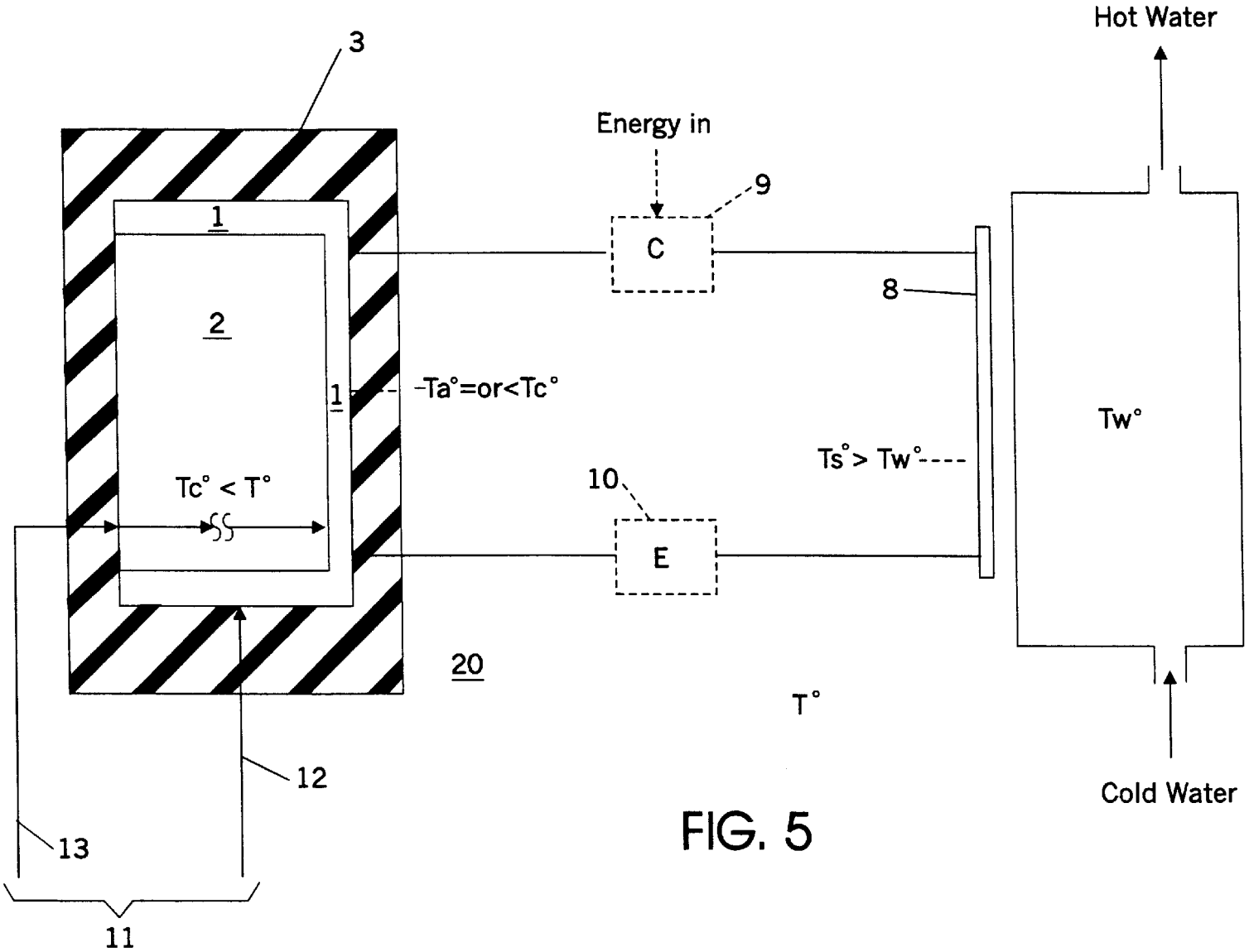
FIG. 5 is a process schematic of a combination system for using reject heat from a refrigerator for heating water using a partially enveloping heat supplier.
Figure 6:
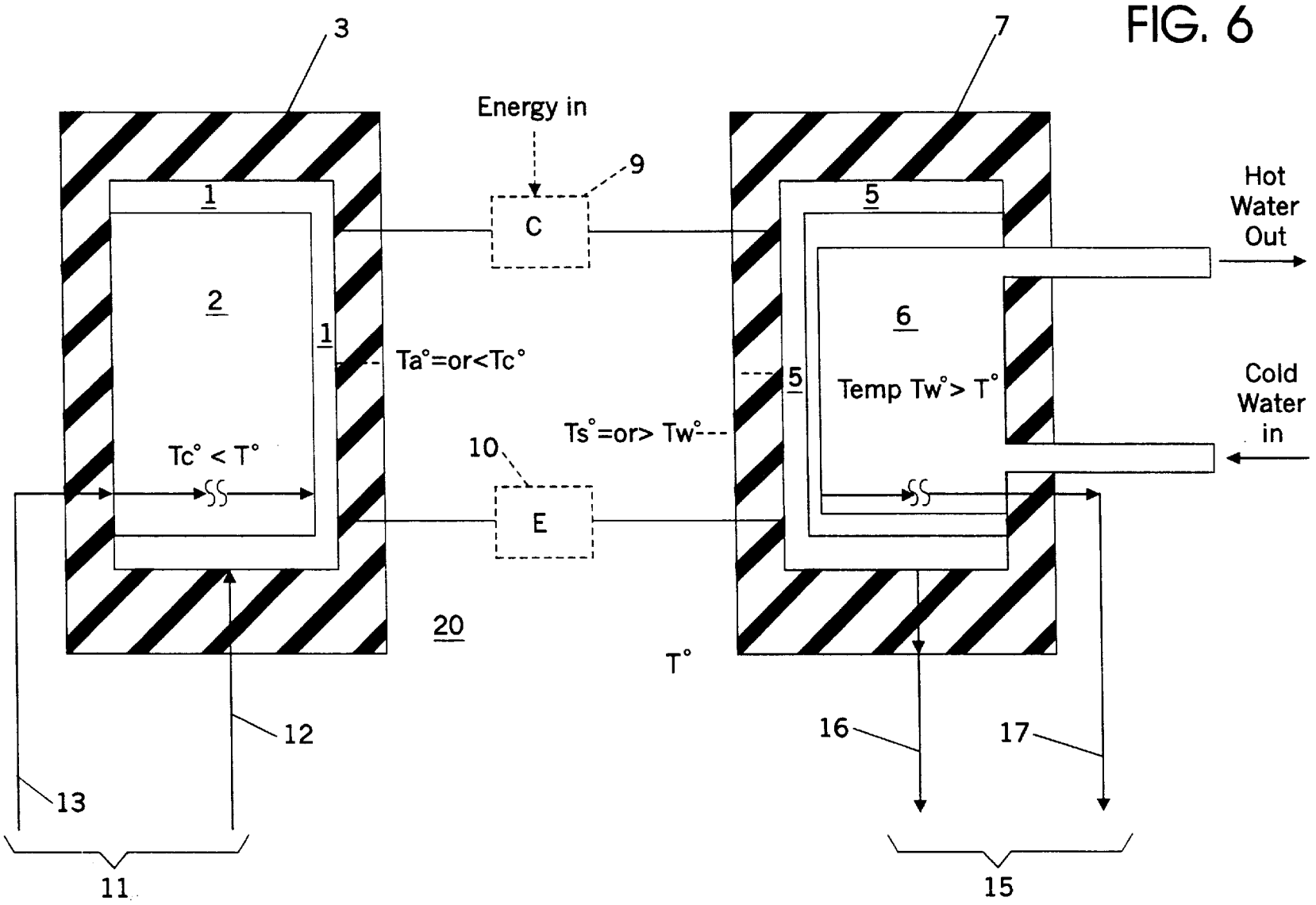
FIG. 6 is a process schematic of a combination system for using reject heat from a refrigerator for heating water using a largely enveloping heat supplier.

As shown in FIGS. 4, 5 and 6, the present invention also includes, specifically in regard to residential type refrigerators, the recovery of the reject heat for use in heating, and maintaining the temperature of water to meet associated residential type requirements for hot water, said reject heat being frequently well coordinated in amount, temperature, location, and operating cycle, with said water requirements.

Preferred Embodiments of the present invention are numerous and include the following:

Preferred Embodiment Number 1

A vapor/compression refrigerator, suitable for residential or similar use, with evaporator (heat absorber) constructed so as to envelop the enclosed space of each compartment on five, more-or-less, of the six faces (each of the enclosures being approximately cuboidal in shape). The small increase in efficiency due to enveloping the door (i.e. the sixth face of the cuboid) would, in most cases, be outweighed by additional construction complexity and therefore cost), but if necessary this could be accomplished by use of separate refrigeration systems for the doors or by use of readily available flexible connectors.

Compartments operating at significantly different temperatures, such as the freezer and storage cabinets should preferably be served by separate evaporator/compressor/expansion valve systems but this is not essential and not a claim of the present disclosure. The largely enveloping evaporators, in this embodiment, are constructed of two layers of sheet metal, such as steel, copper, stainless steel or aluminum, forming a double wall and joined together by a triangular pitched matrix of resistance welds, and a continuous weld to seal the edges, to contain the pressure of the refrigerant. Five, more-or-less, faces of the inner lining of each compartment are constructed in this way. Each of the faces could be constructed separately and then assembled into five faces of a cuboid but it might be better to construct two approximate cuboids each with one face missing, insert one inside the other and then join the two together to form a single double walled cuboid with one face missing. Typically a gap of 0.01 inch between the two layers of the double wall is adequate. Smaller gaps, down to 0.001 inch (or even less), could be adequate for some heat loads or with independent distribution systems but needs for gaps smaller than 0.001 inch are not likely to be encountered in practice. Larger gaps, up to about 0.2 inch (or even larger), could be used but needs for gaps larger than 0.2 inch are not likely to be encountered in practice.

Such evaporators, when equipped with properly sized compressors and expansion valves, will normally operate at temperatures within about 1° F. below that of the contents of the enclosed space, and will therefore consume less work for compression than conventional "immersed" evaporators operating at temperatures about 25° F. below that of the contents of the enclosed space. Specific action, necessary to effect the energy savings made possible by constructing the heat absorber so as to largely envelop the enclosed spaces by reducing the temperature difference between heat supplier and heat absorber substantially to the minimum value at which the given insulated enclosure, heat absorber and heat supplier, being surrounded by the given surroundings at given temperature, in the absence of other heat absorbers and in the absence of other heat suppliers, could maintain the given space at the given depressed temperatures, can comprise; constructing and operating the refrigerating device to operate at rates which do not substantially exceed needs; in a vapor compression system, constructing and operating the compressor to operate at displacement rates which do not substantially exceed needs; in an absorption systems constructing and operating the generator to be heated at rates which do not substantially exceed needs; or in a thermoelectric system, constructing and operating the hot and cold junctions to operate with electromotive forces which do not substantially exceed needs. An electrically powered refrigerator equipped with largely enveloping evaporators and properly sized compressors and expansion valves, consumes about 30% less electricity for compression than an otherwise similar electrically powered appliance equipped with conventional "immersed" type evaporators and properly sized compressors and expansion valves, both appliances being equipped with separate evaporators, compressors and expansion valves for each compartment, and typically equipped with doors, controls and insulation. This is, of course, only an approximation. The actual improvement depends on the case in question.

Each of the two compartments of Embodiment Number 1 would be similar to the apparatus depicted in FIG. 1, with the unenveloped side of the rectangle representing the door and the three enveloped sides representing the other five, more-or-less, faces of the compartment. The two compartments could be stacked one on top of the other or side by side. Except for the Heat Suppliers, all of the equipment depicted in FIG. 1 could be located inside the appliance's outer casing in the usual way. The Heat Supplier could be mounted on the back, top or underneath of said casing. Variations on these detailed locations are possible.

Preferred Embodiment Number 2

A vapor/compression heat pump, suitable for maintaining the contents of a residence, or similar structure, at about 70° F., with condenser (Heat Supplier) constructed so as to largely envelop the enclosed space on the inside surface of all or most of the outside walls and ceilings. Appropriate gaps are provided for windows and doors.

Apart from obvious differences in geometry, and the fabrication techniques used for construction of residences as opposed to kitchen appliances, the details of construction would be similar to those in Embodiment Number 1.

The structure, of Embodiment Number 2, would be similar to the apparatus depicted in FIG. 2, with the unenveloped side of the rectangle representing numerous doors, windows and other openings and possibly the ground floor, which might not need to be enveloped in some circumstances. The three enveloped sides representing the parts of the outside walls and ceilings which are enveloped. Except for the Heat Absorber, all of the equipment depicted in FIG. 2 could be located inside the structure but it is more usual to locate the compressor 9 outside. The Heat Absorber would usually be located outside of the structure.

Variations on these detailed locations are possible.

As is common practice the heat pump cycle could be reversed to provide refrigeration of the structure when necessary.

The Enclosure Heat Exchangers could be constructed as double walled panels very similar to those described for Embodiment Number 1 but formation of a single, double walled, cuboidal module is likely to be limited to prefabricated structures such as mobile homes and vending kiosks. For site built frame structures and many other types of structure it may be preferable for the Enclosure Heat Exchangers to be constructed as standard size panels similar in size to common building lining materials such as sheet rock or decorative panelling. In some cases the flow path for refrigerant through such panels could be much longer relative to flow cross sectional area, which could necessitate wider gaps, between the two walls of the Enclosure Heat Exchanger panels, than for comparable appliance panels. Even so these gaps will not be large enough to be prohibitive.

Preferred Embodiment Number 3

The reject heat from a residence's refrigerator is used to raise and maintain the temperature of water, to meet the residence's requirements for hot water.

The amount and temperature of heat typically rejected from a residence's refrigerator frequently closely match the amount and temperature of heat required for heating the residence's water requirements for bathing and washing etc. Also the refrigerator and the hot water tank are frequently located close to each other, or if not can frequently be so located. Also the operating cycles of the refrigerator and the hot water tank are frequently compatible. In order to optimize the benefits of this embodiment, the provision of a larger than average hot water tank may prove desirable in some cases, so that the refrigerator's reject heat can slowly heat up the entire working volume of water in the tank over a 24 hour period.

Excess heat may be available under some circumstances and may be discarded through a refrigerant-to-air or hot water-to-air heat exchanger, or by numerous other means many of which are well known. Extra heat may be required under some circumstances and may be provided by conventional means.

The temperature of the hot water system may be maintained, and heat may be supplied to the water, by heat exchangers which may be of largely "enveloping" design, as depicted in FIG. 6 or of other designs, as depicted in FIGS. 4 and 5 for example. Thermal contact may be through a single layer of heat conducting material (not illustrated) or through two layers of heat conducting material separated by a gap, which may be open to atmosphere to preclude cross contamination and to facilitate independent portability and operation, as depicted in FIGS. 4 through 6. The overall thermal efficiency tends to increase as the degree of envelopment increases. That is; the total quantity of energy which must be supplied (1.) to drive the refrigeration system and (2.) to heat the water tends to decrease as the degree of envelopment is increased, although the relative requirements for refrigeration and water heating may, in some circumstances, negate this otherwise advantageous tendency. In this embodiment the refrigerator's Heat Absorber is of the enveloping type. The Heat Suppliers (8 in FIGS. 4 and 5, and 5 in FIG. 6) panels could be constructed similarly to those used for Heat Absorbers, as described in Embodiment Number 1. The Heat Suppliers 8 in FIGS. 4 and 5, could be constructed as vertical panels which would be mounted face to face with the water side heat receiving panels which would be sized, shaped, and located so as to readily mate with the Heat Suppliers. Those shown as item 5 in FIG. 6 would usually be formed as a pair of semi-cylindrical panels fabricated to envelop the vertical cylindrical sides of a typical hot water tank.

Preferred Embodiment Number 4

Residential, or similar, TYPE systems, as described in Embodiment Number 3 applied to non-residential situations such as hotels, schools, offices, hospitals, trains, boats and planes.

Preferred Embodiment Number 5

The use of refrigerators' reject heat, much as described in Embodiment Numbers 3 and 4 for refrigerators equipped with enveloping Heat Absorbers, but for conventional refrigerators equipped with "immersed" type Heat Absorbers.

The energy savings, resulting from recovery of refrigerators' reject heat for water heating, are frequently substantially greater than the energy savings, resulting from adoption of the enveloping heat absorber for the associated refrigerators. Opportunities to exploit the former may be encountered even when the latter cannot be economically justified, and vice versa of course.

Preferred Embodiment Number 6

Improvements, as described for Preferred Embodiments 1–5 and 9, but in which the materials of construction of the Enclosure Heat Exchangers and/or the other Heat Exchangers are not limited to metals. Materials of construction must be compatible with the refrigerants and/or other materials contacted, at expected temperature and pressures. High thermal conductivity is a less critical requirement for "enveloping" type heat exchangers because they are installed so as to avoid large heat flows across gas to exchanger interfaces. Certain plastic or ceramic materials may be found to be suitable for "enveloping" type heat exchangers even though they may not be suitable for "immersion" type heat exchangers.

Preferred Embodiment Number 7

Improvements, as described for Preferred Embodiments 1–6 and 8, but in which the heat exchanger walls are joined by fastening systems other than resistance welding. Such systems include soldering, brazing, arc and torch welding, riveting, bolting and screwing systems.

Preferred Embodiment Number 8

Improvements, as described for Preferred Embodiments 1–7, but in which the heat exchanger walls fasteners are located in patterns other than triangular pitch.

Preferred Embodiment Number 9

Improvements, as described for Preferred Embodiments 1–8, but in which other types of hollow wall construction are used to build the heat exchangers. Such systems include tube wall construction and tubes connected together by thermally conducting strips as described by Tyree in U.S. Pat. No. 4,498,306.

Notes on the Preferred Embodiments in general

In the drawings and Preferred Embodiments reference to some components, which are common to the prior art and the present invention, have been omitted. Kitchen appliances require outer cabinets, protective coatings and other components, and residential type structures require weather protection, doors, windows and numerous other components.

The foregoing descriptions of the Preferred Embodiments of the invention have been presented for the purposes of illustration and description. It is not intended to be exhaustive or to limit the invention to the precise form disclosed, Many modifications and variations are possible in light of the above teaching, It is intended that the scope of the invention be limited not by this detailed description, but rather by the claims appended hereto.

I claim:

1. A method for increasing the energy efficiency of a refrigeration system of the type comprising insulated enclosing means; a space, to be maintained at depressed temperatures, and separated from its surroundings by said enclosing means; heat absorber means, on the inside of said enclosing means; heat supplier means, outside of said enclosing means and to be maintained at a temperature which is greater than that of said surroundings; and refrigerating means to depress the temperature of said heat absorber means; energy being supplied to said refrigerating means in order to maintain the temperature difference between said heat supplier means and said heat absorber means wherein the method comprises constructing said heat absorber means to largely envelop said space and reducing said temperature difference between said heat supplier means and said heat absorber means substantially to the minimum value whereat said insulated enclosing means; said heat absorber means, on the inside of said enclosing means and constructed to largely envelop said space; and said heat supplier means, outside of said enclosing means and to be maintained at a temperature which is greater than that of said surroundings; being surrounded by said surroundings at said temperature of said surroundings, in the absence of other heat absorption means and in the absence of other heat supplier means; could maintain said space at said depressed temperatures.

2. A method for increasing the energy efficiency of a heat pumping system of the type comprising insulated enclosing means; a space, to be maintained at desired temperatures, and separated from its surroundings by said enclosing means; heat supplier means, on the inside of said enclosing means; heat absorber means, outside of said enclosing means; and heat pumping means to maintain the temperature of said heat supplier means wherein the method comprises constructing said heat supplier means to largely envelop said space and reducing the temperature difference between said heat supplier means and said heat absorber means, substantially to the minimum value whereat said insulated enclosing means; said heat supplier means, on the inside of said enclosing means and constructed to largely envelop said space; and said heat absorber means, outside of said enclosing means; being surrounded by said surroundings, in the absence of other heat absorption means and in the absence of other heat supplier means; could maintain said space at said desired temperatures.

3. A method for increasing the energy efficiency of a combination refrigeration/heat pumping system of the type comprising insulated enclosing means; a space, to be maintained at depressed temperatures, and separated from its surroundings by said enclosing means; heat absorber means, on the inside of said enclosing means; further insulated enclosing means; a further space, to be maintained at desired temperatures, and separated from its surroundings by said further enclosing means; heat supplier means, on the inside of said further enclosing means; and refrigerating/heat pumping means to depress the temperature of said heat absorber means and to maintain the temperature of said heat supplier means wherein the method comprises constructing said heat supplier means so as to largely envelop said further space, to be maintained at desired temperatures and reducing the temperature difference between said heat supplier means and said heat absorber means, substantially to the minimum value whereat said first mentioned insulated enclosing means; said heat absorber means, on the inside of said first mentioned enclosing means; said further insulated enclosing means and said heat supplier means, on the inside of said further enclosing means and constructed to largely envelop said further space; being surrounded by said surroundings, in the absence of other heat absorption means and in the absence of other heat supplier means, could maintain said first mentioned space at said depressed temperatures and said further space at said desired temperatures.

4. a method for increasing the energy efficiency of a refrigeration system of the type comprising insulated enclosing means; an enclosed space, separated from its surroundings by said enclosing means and to be maintained at temperatures below the temperature of said surroundings; enclosure heat exchanger means, being the heat absorber means in said refrigeration system; the contents of said enclosed space being maintained at said temperatures below said temperature of said surroundings by said heat absorber means which exchanges heat with said contents of said enclosed space and which is to be maintained at a temperature, which is no greater than that of said contents of said enclosed space; and heat supplier means, to be immersed in the surroundings and to be maintained at a temperature which is greater than that of said surroundings; energy being supplied to said refrigeration system in order to maintain the temperature difference between said heat supplier means and said heat absorber means wherein the method comprises constructing said heat absorber means so as to largely envelop said enclosed space and reducing said temperature difference between said heat supplier means and said heat absorber means, substantially to the minimum value whereat said insulated enclosing means; said enclosure heat exchanger means, being the heat absorber means in said refrigeration system and constructed to largely envelop said enclosed space and said heat supplier means, to be immersed in the surroundings; being surrounded by said surroundings at said temperature of said surroundings, in the absence of other heat absorption means and in the absence of other heat supplier means; could maintain said enclosed space, separated from said surroundings by said enclosing means, at said temperatures below said temperature of said surroundings.

5. A method for increasing the energy efficiency of the heat pumping process, by which the contents of an enclosed space, separated from its surroundings by enclosing means, are maintained at a temperature which is greater than the temperature of said surroundings, wherein the method comprises constructing the heat supplier, of said heat pumping process, so as to largely envelop said enclosed space and reducing the temperature difference between said heat supplier means and the heat absorber means, substantially to the minimum value whereat said enclosing means; said heat supplier and said heat absorber; being surrounded by said surroundings at said temperature of said surroundings, in the absence of other heat absorption means and in the absence of other heat supplier means; could maintain said enclosed space, separated from said surroundings by said enclosing means, at said temperature which is greater than said temperature of said surroundings.

6. A method for increasing the energy efficiency of a combination refrigeration/heat pumping system of the type comprising insulated enclosing means; a space, to be maintained at depressed temperatures, separated from its surroundings by said enclosing means; heat absorber means, on the inside of said enclosing means; further insulated enclosing means; a further space, to be maintained at desired temperatures, separated from its surroundings by said further enclosing means; heat supplier means, on the inside of said further enclosing means; and refrigerating/heat pumping means to depress the temperature of said heat absorber means and to maintain the temperature of said heat supplier means wherein the method comprises constructing said heat absorber means so as to largely envelop said first mentioned space, to be maintained at depressed temperatures and reducing the temperature difference between said heat supplier means and said heat absorber means substantially to the minimum value whereat said first mentioned insulated enclosing means; said heat absorber means, on the inside of said first mentioned enclosing means and constructed to largely envelop said first mentioned space; said further insulated enclosing means and said heat supplier means, on the inside of said further enclosing means; being surrounded by said surroundings, in the absence of other heat absorption means and in the absence of other heat supplier means, could maintain said first mentioned space at said depressed temperatures and said further space at said desired temperatures.

7. The improvement as claimed in claim 3 wherein the improvement comprises construction of said heat absorber means so as to largely envelop said first mentioned space, to be maintained at depressed temperatures.

8. A method for increasing the energy efficiency of a vapor compression refrigeration system of the type comprising insulated enclosing means; a space, to be maintained at depressed temperatures, and separated from its surroundings by said enclosing means; evaporator means, on the inside of said enclosing means; condenser means, outside of said enclosing means; and compressor means wherein the method comprises constructing said evaporator means to largely envelop said space and constructing and operating said compressor means to operate at displacement rates which do not substantially exceed needs so as to reduce said temperature difference between said condenser means and said evaporator means, substantially, to the minimum value whereat said insulated enclosing means; said evaporator means on the inside of said enclosing means and constructed to largely envelop said space; and said condenser means, outside of said enclosing means; being surrounded by said surroundings at said temperature of said surroundings, in the absence of other heat absorption means and in the absence of other heat supplier means; could maintain said space at said depressed temperatures.

9. A method for increasing the energy efficiency of an absorption refrigeration system of the type comprising insulated enclosing means; a space, to be maintained at depressed temperatures, and separated from its surroundings by said enclosing means; evaporator means, on the inside of said enclosing means; condenser means, outside of said enclosing means; and generator and absorber means wherein the method comprises constructing said evaporator means to largely envelop said space and constructing and operating said generator means to be heated at rates which do not substantially exceed needs so as to reduce said temperature difference between said condenser means and said evaporator means, substantially, to the minimum value whereat said insulated enclosing means; said evaporator means, on the inside of said enclosing means and constructed to largely envelop said space; and said condenser means outside of said enclosing means; being surrounded by said surroundings at said temperature of said surroundings, in the absence of other heat absorption means and in the absence of other heat supplier means; could maintain said space at said depressed temperatures.

10. A method for increasing the energy efficiency of a thermoelectric refrigeration system of the type comprising insulated enclosing means; a space, to be maintained at depressed temperatures, and separated from its surroundings by said enclosing means; cold junction means, on the inside of said enclosing means; and hot junction means, outside of said enclosing means wherein the method comprises constructing said cold junction means to largely envelop said space and constructing and operating said hot and cold junction means to operate with electromotive forces which do not substantially exceed needs so as to reduce said temperature difference between said hot junction means and said cold junction means, substantially, to the minimum value whereat said insulated enclosing means; said cold junction means, on the inside of said enclosing means nd constructed to largely envelop said space; and said hot junction means, outside of said enclosing means; being surrounded by said surroundings at said temperature of said surroundings, in the absence of other heat absorption means and in the absence of other heat supplier means; could maintain said space at said depressed temperatures said hot and cold junction means to operate with electromotive forces which do not substantially exceed needs.

11. a method for increasing the energy efficiency of a vapor compression heat pumping system of the type comprising insulated enclosing means; a space, to be maintained at desired temperatures, and separated from its surroundings by said enclosing means; condenser means, on the inside of said enclosing means; evaporator means, outside of said enclosing means; and compressor means wherein the method comprises constructing said condenser means to largely envelop said space and constructing and operating said compressor means to operate at displacement rates which do not substantially exceed needs so as to reduce said temperature difference between said condenser means and said evaporator means, substantially, to the minimum value whereat said insulated enclosing means; said condenser means, on the inside of said enclosing means and constructed to largely envelop said space; and said evaporator means, outside of said enclosing means; being surrounded by said surroundings at said temperature of said surroundings, in the absence of other heat absorption means and in the absence of other heat supplier means; could maintain said space at said depressed temperatures.

12. A method for increasing the energy efficiency of an absorption heat pumping system of the type comprising insulated enclosing means; a space, to be maintained at desired temperatures, and separated from its surroundings by said enclosing means; condenser means, on the inside of said enclosing means; evaporator means, outside of said enclosing means; and generator and absorber means wherein the method comprises constructing said condenser means to largely envelop said space and constructing and operating said generator means to receive heat at rates which do not substantially exceed needs so as to reduce said temperature difference between said condenser means and said evaporator means, substantially to the minimum value whereat said insulated enclosing means; said generator means, on the inside of said enclosing means and constructed to largely envelop said space; and said evaporator means, outside of said enclosing means; being surrounded by said surroundings at said temperature of said surroundings, in the absence of other heat absorption means and in the absence of other heat supplier means; could maintain said space at said depressed temperatures.

13. A method for increasing the energy efficiency of a thermoelectric heat pumping system of the type comprising insulated enclosing means; a space, to be maintained at desired temperatures, and separated from its surroundings by said enclosing means; hot junction means, on the inside of said enclosing means; and cold junction means, outside of said enclosing means wherein the method comprises constructing said hot junction means means to largely envelop said space and constructing and operating said hot and cold junction means to operate with electromotive forces which do not substantially exceed needs so as to reduce said temperature difference between said hot junction means and said cold junction means, substantially, to the minimum value whereat said insulated enclosing means; said hot junction means, on the inside of said enclosing means and constructed to largely envelop said space; and said cold junction means, outside of said enclosing means; being surrounded by said surroundings at said temperature of said surroundings, in the absence of other heat absorption means anti in the absence of other heat supplier means; could maintain said space at said depressed temperatures.

14. A method for increasing the energy efficiency of a refrigeration system of the type comprising insulated enclosing means; a space, to be maintained at depressed temperatures, and separated from its surroundings by said enclosing means; heat absorber means, on the inside of said enclosing means; heat supplier means, outside of said enclosing means and to be maintained at a temperature which is greater than that of said surroundings; and refrigerating means to depress the temperature of said heat absorber means; energy being supplied to said refrigerating means in order to maintain the temperature difference between said heat supplier means and said heat absorber means wherein the method comprises constructing said heat absorber means to largely envelop said space and reducing said temperature difference between said heat supplier means arid said heat absorber means, substantially, to the minimum value whereat said insulated enclosing means; said heat absorber means, on the inside of said enclosing means and constructed to largely envelop said space; and said heat supplier means, outside of said enclosing means and to be maintained at a temperature which is greater than that of said surroundings; being surrounded by said surroundings at said temperature of said surroundings, in the absence of other heat absorption means and in the absence of other heat supplier means; could maintain said space at said depressed temperatures, by providing heat accumulator means in thermal communication with said heat supplier means.

15. A method for increasing the energy efficiency of a heat pumping system of the type comprising insulated enclosing means; a space, to be maintained at desired temperatures, and separated from its surroundings by said enclosing means; heat supplier means, on the inside of said enclosing means; heat absorber means, outside of said enclosing means; and heat pumping means to maintain the temperature of said heat supplier means wherein the method comprises constructing said heat supplier means to largely envelop said space and reducing said temperature difference between said heat supplier means and said heat absorber means, substantially, to the minimum value whereat said insulated enclosing means; said heat supplier means on the inside of said enclosing means and constructed to largely envelop said space; and said heat absorber means, outside of said enclosing means; being surrounded by aid surroundings, in the absence of other heat absorption means and in the absence of other heat supplier means; could maintain said space at said desired temperatures, by providing heat accumulator means in thermal communication with said heat absorber means.

16. A method for increasing the energy efficiency of a refrigeration system of the type comprising insulated enclosing means; a space, to be maintained at depressed temperatures, and separated from its surroundings by said enclosing means; heat absorber means, on the inside of said enclosing means and constructed to largely envelop said space; heat supplier means, outside of said enclosing means and to be maintained at a temperature which is greater than that of said surroundings; and refrigerating means to depress the temperature of said heat absorber means; energy being supplied to said refrigerating means in order to maintain the temperature difference between said heat supplier means and said heat absorber means wherein the method comprises constructing and operating said refrigerating means so as to reduce said temperature difference between said heat supplier means and said heat absorber means substantially to the minimum value whereat said insulated enclosing means; said heat absorber means, on the inside of said enclosing means and constructed to largely envelop said space; and said heat supplier means, outside of said enclosing means and to be maintained at a temperature which is greater than that of said surroundings; being surrounded by said surroundings at said temperature of said surroundings, in the absence of other heat absorption means and in the absence of other heat supplier means; could maintain said space at said depressed temperatures.

17. A method for increasing the energy efficiency of a heat pumping system of the type comprising insulated enclosing means; a space, to be maintained at desired temperatures, and separated from its surroundings by said enclosing means; heat supplier means, on the inside of said enclosing means and constructed to largely envelop said space; heat absorber means, outside of said enclosing means; and heat pumping means to maintain the temperature of said heat supplier means wherein the method comprises constructing operating said heat pumping means so as to reduce the temperature difference between said heat supplier means and said heat absorber means, substantially to the minimum value whereat said insulated enclosing means; said heat supplier means, on the inside of said enclosing means and constructed to largely envelop said space; and said heat absorber means, outside of said enclosing means; being surrounded by said surroundings, in the absence of other heat absorption means and in the absence of other heat supplier means; could maintain said space at said desired temperatures.

* * * * *